US009212441B2

(12) United States Patent
Bison et al.

(10) Patent No.: US 9,212,441 B2
(45) Date of Patent: Dec. 15, 2015

(54) LAUNDRY MACHINE WITH AN INTEGRATED HEAT PUMP SYSTEM

(75) Inventors: Alberto Bison, Pordenone (IT); Igor Colin, Cordenons (IT); Maurizio Del Pos, Pordenone (IT); Paolo Olivaro, Orsago (IT)

(73) Assignee: Electrolux Home Products Corporation N.V., Brussels (BE)

( * ) Notice: Subject to any disclaimer, the term of this patent is extended or adjusted under 35 U.S.C. 154(b) by 1178 days.

(21) Appl. No.: 13/099,137

(22) Filed: May 2, 2011

(65) Prior Publication Data

US 2011/0265523 A1 Nov. 3, 2011

(30) Foreign Application Priority Data

May 3, 2010 (EP) ..... 10161723

(51) Int. Cl.

| | |
|---|---|
| ***D06F 29/00*** | (2006.01) |
| ***F26B 21/00*** | (2006.01) |
| ***D06F 25/00*** | (2006.01) |
| ***D06F 58/02*** | (2006.01) |
| ***D06F 58/20*** | (2006.01) |

(52) U.S. Cl.
CPC ..... *D06F 25/00* (2013.01); *D06F 58/02* (2013.01); *D06F 58/206* (2013.01)

(58) Field of Classification Search
CPC ..... D06F 25/00; D06F 58/206; D06F 58/02
USPC ..... 68/3 R, 20
See application file for complete search history.

(56) References Cited

U.S. PATENT DOCUMENTS

| | | | | |
|---|---|---|---|---|
| 2,957,330 | A * | 10/1960 | Cline | 68/20 |
| 3,089,327 | A * | 5/1963 | Stilwell, Jr. | 68/139 |
| 7,194,823 | B2 * | 3/2007 | Nakamoto et al. | 34/526 |
| 2005/0034491 | A1 * | 2/2005 | Tazawa et al. | 68/12.03 |
| 2005/0120577 | A1 * | 6/2005 | Nakamoto et al. | 34/74 |
| 2005/0223502 | A1 * | 10/2005 | Kleker | 8/158 |
| 2006/0137105 | A1 * | 6/2006 | Hong et al. | 8/147 |
| 2008/0189974 | A1 * | 8/2008 | Dittmer et al. | 34/132 |
| 2008/0235977 | A1 * | 10/2008 | Kuwabara | 34/77 |
| 2009/0151188 | A1 * | 6/2009 | Moon et al. | 34/218 |
| 2009/0211309 | A1 * | 8/2009 | Kawabata et al. | 68/20 |
| 2009/0249837 | A1 * | 10/2009 | Uhara et al. | 68/19 |
| 2010/0077787 | A1 * | 4/2010 | Masuda et al. | 62/324.5 |
| 2010/0223960 | A1 * | 9/2010 | Kim et al. | 68/20 |

FOREIGN PATENT DOCUMENTS

| | | |
|---|---|---|
| EP | 1 411 163 | 4/2004 |
| EP | 1 619 286 | 1/2006 |
| WO | 2008/103007 | 8/2008 |

* cited by examiner

*Primary Examiner* — Michael Barr
*Assistant Examiner* — Benjamin L Osterhout
(74) *Attorney, Agent, or Firm* — Banner & Witcoff, Ltd.

(57) ABSTRACT

A laundry machine includes an integrated heat pump system. The laundry machine comprises a cabinet (10). A tub (12) is associated to the cabinet (10). An air line is fluidly connected to the tub and to the heat pump system for air recirculation. A rotatable drum (14) is arranged within the tub (12) and resiliently supported at the cabinet (10) and/or at the tub (12) so that the tub (12) is stationary with respect to the cabinet (10) during operation of the machine, in particular during rotation of the drum (14). At least a part of the components of the heat pump system is supported by the cabinet 10 and/or the tub (12).

20 Claims, 8 Drawing Sheets

LAUNDRY MACHINE WITH AN INTEGRATED HEAT PUMP SYSTEM

CROSS-REFERENCE TO RELATED APPLICATION

This Application claims priority to European Application No. 10161723.1, filed on May 3, 2010.

BACKGROUND OF THE INVENTION

The present invention relates to a laundry machine with an integrated heat pump system.

Heat pump technology can be used as an efficient way to save energy in a laundry washing and/or drying machine. A typical laundry washing and drying machine comprises a closed air stream circuit and a closed refrigerant circuit. The air stream is provided for drying the wet laundry. The air stream circuit and the refrigerant circuit are coupled by at least two heat exchangers.

However, the components of the heat pump system require space inside the cabinet of the washing and drying machine. At the basement of the cabinet there is usually not enough space for the heat pump system. An appropriate place for the heat pump system is above the tub and the drum. Another problem is the oscillation of the tub and drum during the spinning phase.

EP 1 411 163 A2 discloses a washing and drying machine with a heat pump system. The components of the heat pump system are arranged above the tub. Since the tub and the drum are oscillating during the spinning phase, the heat pump system and the tub are connected via flexible hoses.

EP 1 619 286 B1 discloses a drum type washing machine and a bearing housing structure thereof. The tub is installed in a cabinet. A rotatable drum is provided in the tub. The drum is supported by the cabinet via a damping system, so that the tub is stationary.

WO 2008/103007 A2 discloses a drum type washing machine including a cabinet, the tub provided in the cabinet and a rotatable drum provided in the tub. The rotatable drum is supported by the cabinet via a bearing house and supporting portions, so that the tub is directly connected to the cabinet.

SUMMARY OF SELECTED INVENTIVE ASPECTS

It is an object of the present invention to provide a laundry machine with an integrated heat pump system, which overcomes the above problems and allows a simple installation of the heat pump system within the laundry washing and/or drying machine.

The above object of the present invention may be achieved by the laundry washing and drying machine with an integrated heat pump system according to claim 1.

The present invention relates to a laundry machine, preferably to a laundry washing and drying machine with an integrated heat pump system, wherein:

- the laundry machine comprises a cabinet,
- a tub is associated to the cabinet,
- an air line is fluidly connected to the tub and to the heat pump system for air recirculation,
- a rotatable drum is arranged within the tub and resiliently supported by the cabinet and/or the tub,
- so that the tub is stationary with respect of the cabinet during a operation of the machine, in particular during rotation of the drum, and
- at least a part of the components of the heat pump system is supported by the cabinet and/or the tub.

A main idea of the present invention is the tub arranged stationary with respect of the cabinet during the operation of the laundry washing and drying machine. When the drum rotates, the tub and the cabinet form a stationary unit. The heat pump system and components thereof are supported by the cabinet and/or the tub. The drum may be directly or indirectly connected to the cabinet. Thus, only the drum and adjacent component oscillate during the drum rotation phase, but not the tub and/or the heat pump system.

According to a preferred embodiment of the present invention, the tub comprises or is fluidly connected to an air stream channel, wherein at least one heat exchanger is arranged within said air stream channel. The tub is an integrated part of the air stream channel, so that the air can flow through the tub and the drum. This contributes to a low complexity of the laundry washing and drying machine.

Further, the air stream channel is supported by the cabinet and/or the tub. This prevents an oscillating of the air stream channel or components thereof.

Preferably, at least a part of the air stream channel and the tub form a single-piece part. This allows an easy production and contributes to a compact heat pump system.

According to a preferred embodiment of the present invention, the laundry washing and drying machine comprises at least one module including at least one component of the heat pump system. Thus, the module can be installed at the laundry washing and drying machine in a single step.

For example, the module includes at least a part of the air stream channel comprising at least one heat exchanger. This contributes to the impermeability (i.e., air tight sealing) of the air stream channel and the heat exchanger.

According to a preferred embodiment, at least a part of the heat pump system (for example at least one heat exchanger) and/or the module is supported, entirely, by the cabinet. In this case the tub needs no special reinforcements.

For example, the heat pump system is supported by a top wall and/or a side wall of the cabinet.

In an alternative embodiment, at least a part of the heat pump system (for example at least one heat exchanger) and/or the module is supported entirely by the tub.

In a further embodiment, the heat pump system and/or the module is supported partly by the cabinet and partly by the tub.

Further, the drum is resiliently supported at the cabinet and/or at the tub by a vibration damping system having one or more dampers and/or spring elements. Preferably a bearing housing for supporting a rotation shaft of the drum is provided. The vibration damping system is connected to the bearing housing and to the cabinet so that the vibrating/oscillating elements of the machine, such as the drum, are supported in the cabinet by the bearing housing.

Preferably the bearing housing is resiliently connected to the rear portion of the tub, for example, by sealing means to prevent vibration from being transmitted from the vibrating/oscillating elements to the tub and to prevent water accommodated in the tub from leaking.

Preferably the tub comprises a rear portion where the sealing means and the bearing housing are arranged.

Preferably the tub comprises a main body directly fixed to the front side of the cabinet.

Preferably the vibration damping system comprises one or more damping brackets connected to the bearing housing and one or more dampers or spring elements arranged between the damping bracket and the cabinet.

Preferably, the drum is driven by a direct drive motor connected to the bearing housing.

Novel and inventive features the present invention are set forth in the appended claims.

BRIEF DESCRIPTION OF THE DRAWINGS

The invention will be described in further detail with reference to the drawings, in which.

DETAILED DESCRIPTION OF EXAMPLE EMBODIMENTS

Figure 1:
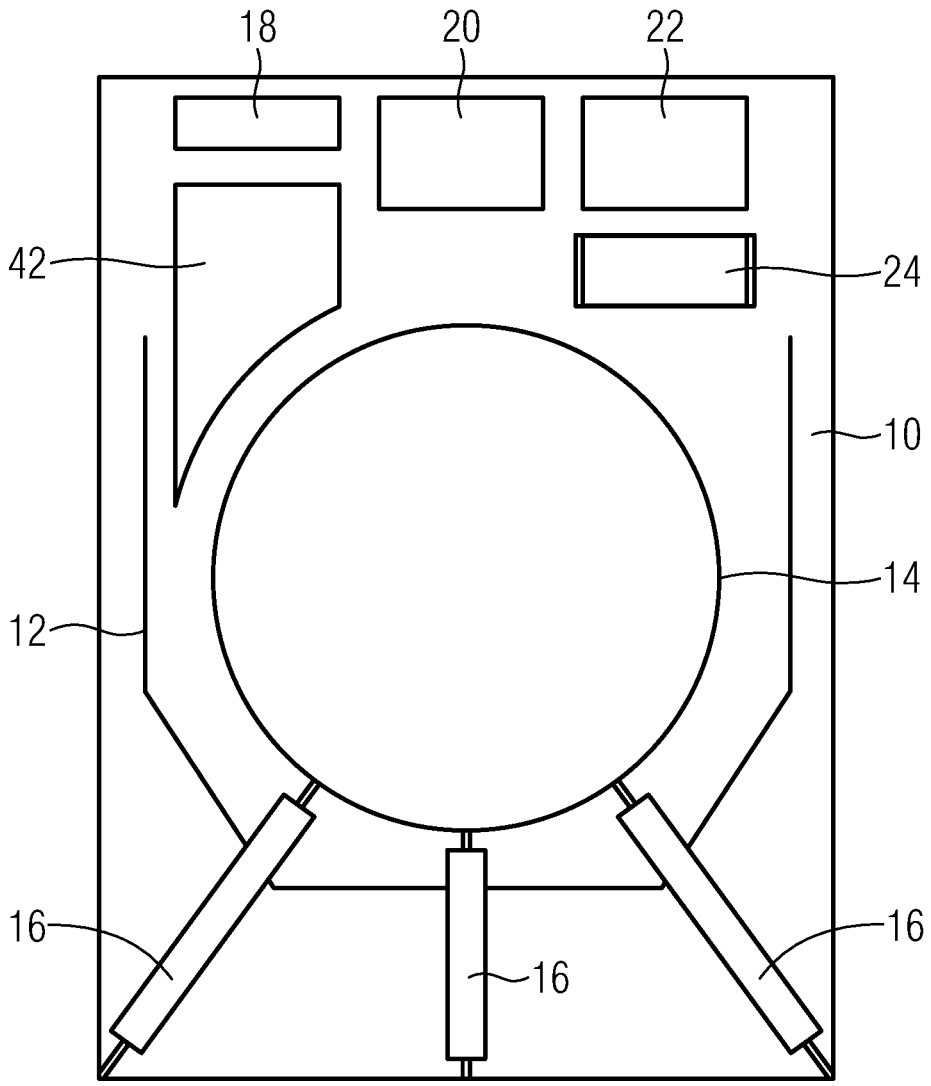
FIG. 1 illustrates a schematic sectional side view of a laundry washing and drying machine with an integrated heat pump system according to a schematic embodiment of the present invention.

FIG. 1 illustrates a schematic sectional side view of a laundry washing and drying machine with an integrated heat pump system according to a schematic embodiment of the present invention.

The laundry washing and drying machine comprises a cabinet 10 with side walls, a top wall and a bottom frame, a tub 12 and a rotating drum 14. The tub 12 is arranged within and directly connected to the cabinet 10, so that the tub 12 is stationary respective to the cabinet 10 also during operation of the machine when the drum rotates. In other words, the tub 12 is directly fixed to the cabinet without the need of dampers and/or springs connecting the tub 12 to the cabinet 10. The drum 14 is arranged within the tub 12. The drum 14 is resiliently supported at the cabinet 10 by a vibration damping system 16. In this example the vibration damping system 16 comprises three dampers and/or spring elements.

Figure 10:
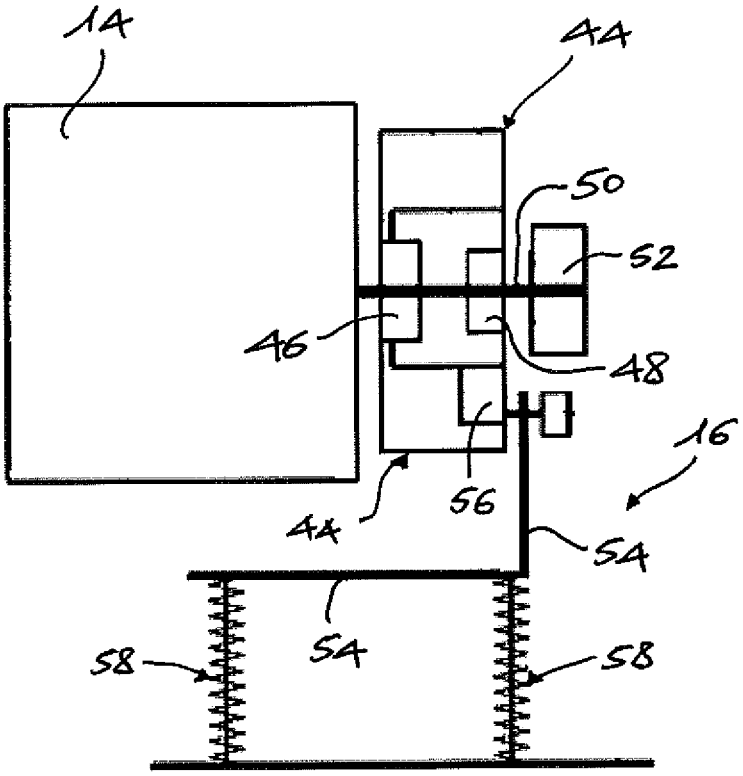
FIG. 10 illustrates a schematic sectional side view of a laundry washing and drying machine according to preferable embodiment of the present invention.

As schematically shown in FIG. 10, the laundry washing and drying machine comprises a bearing housing 44 having first bearing 46 and second bearing 48 for supporting a rotation shaft 50 of the drum 14. The vibration damping system 16 connects the bearing housing 44 to the cabinet 10. The drum 14 is driven by a direct drive motor 52 connected to the bearing housing 44.

The vibration damping system 16 comprises one or more damping brackets 54 connected to a fastening portion 56 of the bearing housing 44 and one or more dampers and/or spring elements 58 arranged between the damping bracket 54 and the cabinet 10.

When the drum 14 rotates, the drum 14, the bearing housing 44 and the motor 52 transfer vibrations to the cabinet 10 by means of the vibration damping system 16, while the tub 12 is not affected by the vibrations/oscillations. Since the tub 12 is stationary at the cabinet 10, the tub 12 and component fixed at said tub 12 do not oscillate.

The laundry washing and drying machine comprises further a filter arrangement 18, an evaporator 20, a condenser 22, fan 24 and a detergent drawer 42. The filter arrangement 18, the evaporator 20, the condenser 22 and the fan 24 are components of the heat pump system.

The heat pump system comprises an open or closed air stream circuit and a closed refrigerant circuit. The air stream circuit is formed by the drum 14, the evaporator 20, the condenser 22 and a fan. The refrigerant circuit is formed by a compressor 38, the evaporator 20, the condenser 22 and optionally an expansion device, for example an expansion valve.

Figure 2:
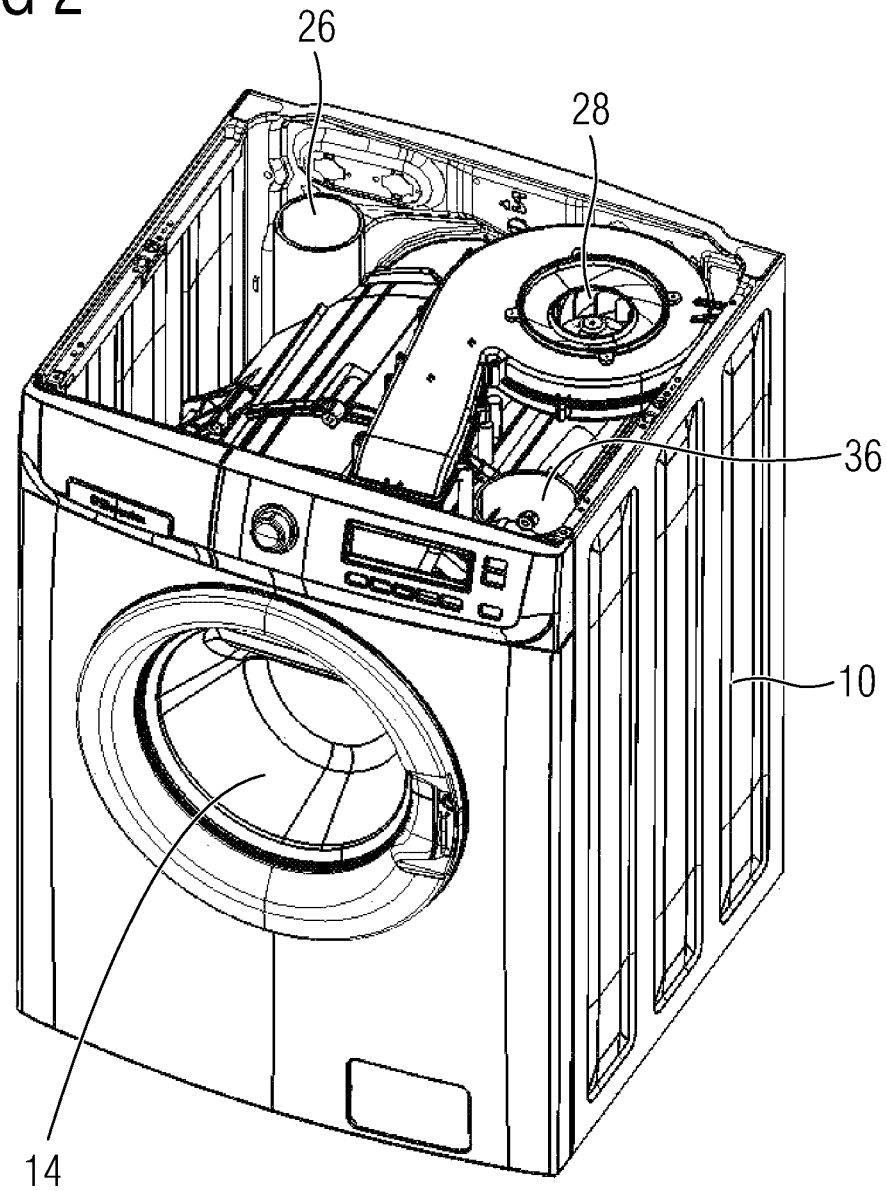
FIG. 2 illustrates a schematic perspective view of an open laundry washing and drying machine according to an embodiment of the present invention.

FIG. 2 illustrates a schematic perspective view of an open laundry washing and drying machine according to an embodiment of the present invention. In FIG. 2 most of the components for heat pump system are not installed.

The laundry washing and drying machine comprises further a tub outlet 26 and a fan inlet 28. The tub outlet 26 and the fan inlet 28 are a part of a closed air stream circuit for the heat pump system. The tub outlet 26 is provided at a rear portion of the washing and drying machine, whereas the tub inlet is provided at a front portion of the washing and drying machine as it can be seen in FIGS. 2 and 4. Additionally, the washing and drying machine comprises a compressor housing 36 provided for inserting a compressor 38. The compressor 38 is a part of a refrigerant circuit for the heat pump system.

Figure 3:
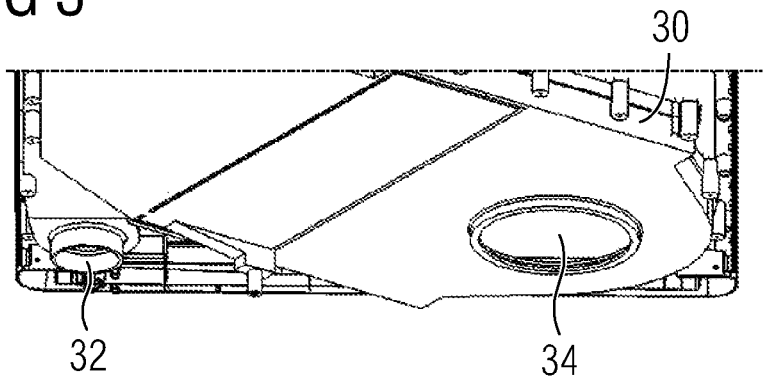
FIG. 3 illustrates a schematic perspective partial view at the bottom side of a module for the heat pump system according to an embodiment of the present invention.

FIG. 3 illustrates a schematic perspective partial view at the bottom side of a module 30 for the heat pump system according to an embodiment of the present invention.

The module 30 includes the filter arrangement 18, the evaporator 20 and the condenser 22. The module 30 includes further an inlet port 32 for the tub outlet 26 and an outlet port 34 for the fan inlet 28. The inlet port 32 and the outlet port 34 are connectable to the tub outlet 26 and to the fan inlet 28, respectively.

The module 30 allows a compact form of substantial components of the heat pump system. By inserting the module 30 into the laundry washing and drying machine the heat pump system or the substantial part thereof may be installed.

Figure 4:
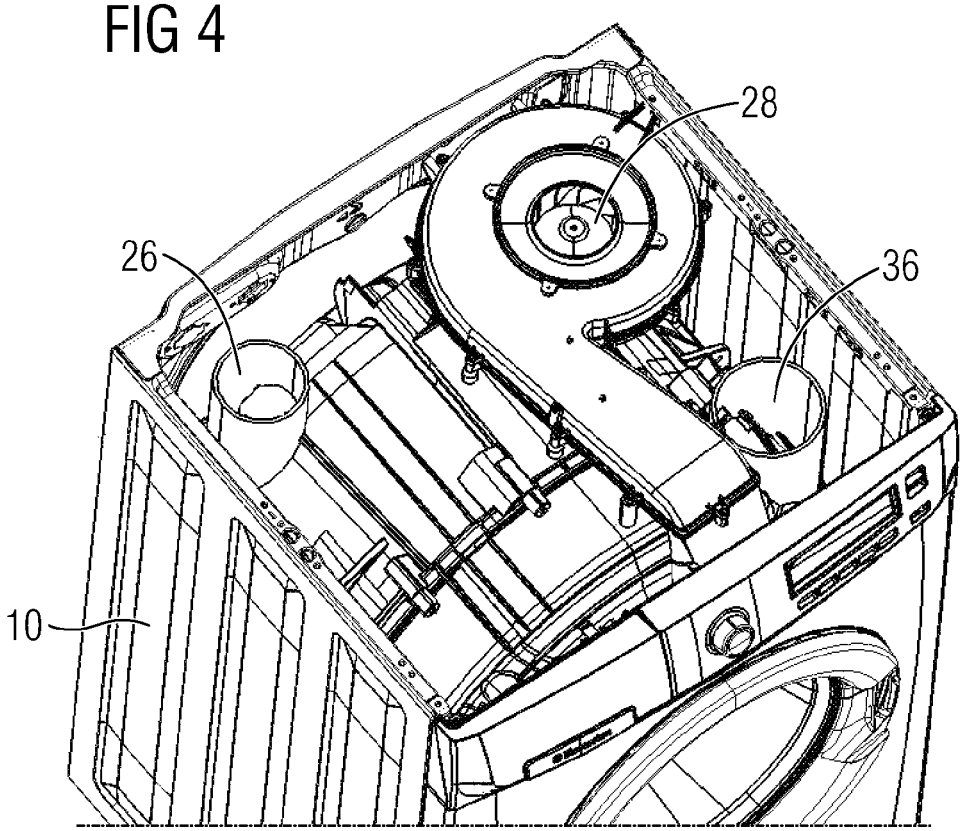
FIG. 4 illustrates a further schematic perspective view of the open laundry washing and drying machine according to an embodiment of the present invention.

FIG. 4 illustrates a further schematic perspective view of the open laundry washing and drying machine according to an embodiment of the present invention. Said open laundry washing and drying machine is the same state as in FIG. 2. In particular, the tub outlet 26, the fan inlet 28 and the compressor housing 36 are shown.

Figure 5:
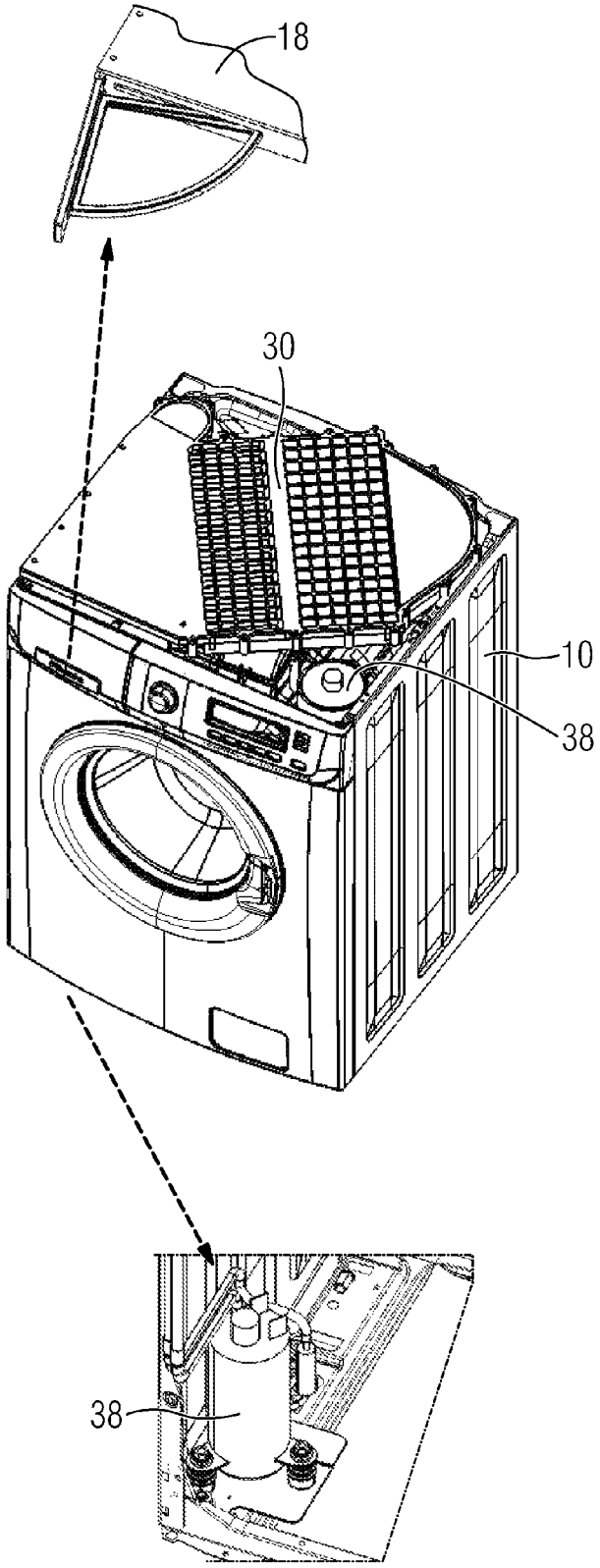
FIG. 5 illustrates a schematic perspective view of the open laundry washing and drying machine with the module for the heat pump system and two further detailed perspective views according to an embodiment of the present invention.

FIG. 5 illustrates a schematic perspective view of the open laundry washing and drying machine with the module for the heat pump system and two further detailed perspective views according to an embodiment of the present invention.

In FIG. 5 the module 30 is inserted into the upper part of the cabinet 10. Further, the compressor 38 is inserted into the compressor housing 36.

An upper detailed perspective view shows the enhanced representation of the filter arrangement 18. The filter arrangement 18 is a part of the module 30 and positioned in the left front corner of said module 30.

A lower detailed perspective view shows an alternative arrangement of the compressor 38 within the basement of the cabinet 10. The alternative position of the compressor 38 is the left front corner in the basement of the cabinet 10.

Figure 6:
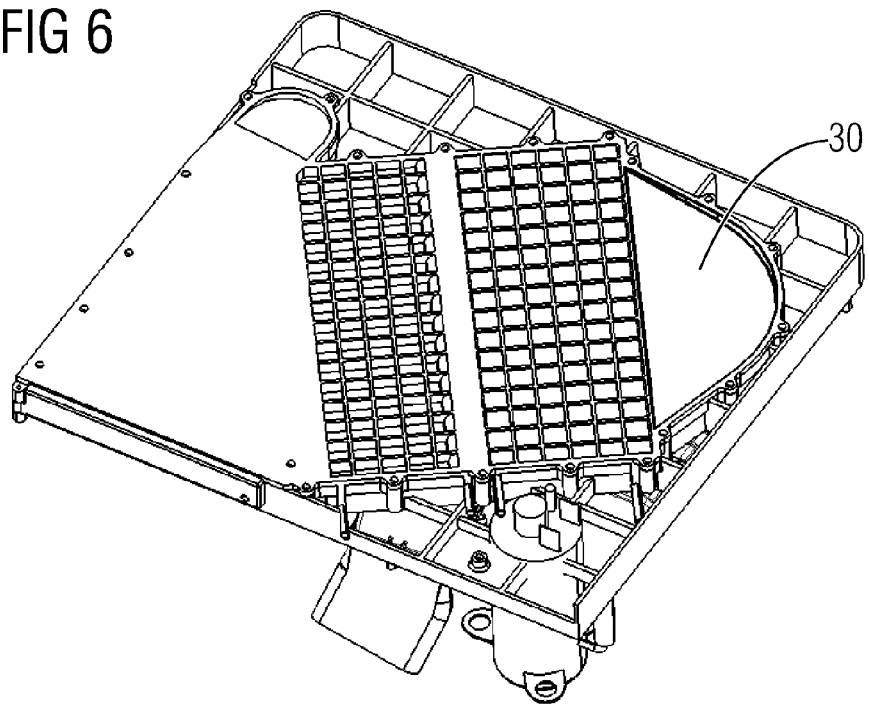
FIG. 6 illustrates a schematic perspective view of the module for the heat pump system according to an embodiment of the present invention.

FIG. 6 illustrates a schematic perspective view of the module 30 for the heat pump system according to an embodiment of the present invention. The module 30 comprises the filter arrangement 18, the evaporator 20, the condenser 22 and the compressor 38.

Figure 7:
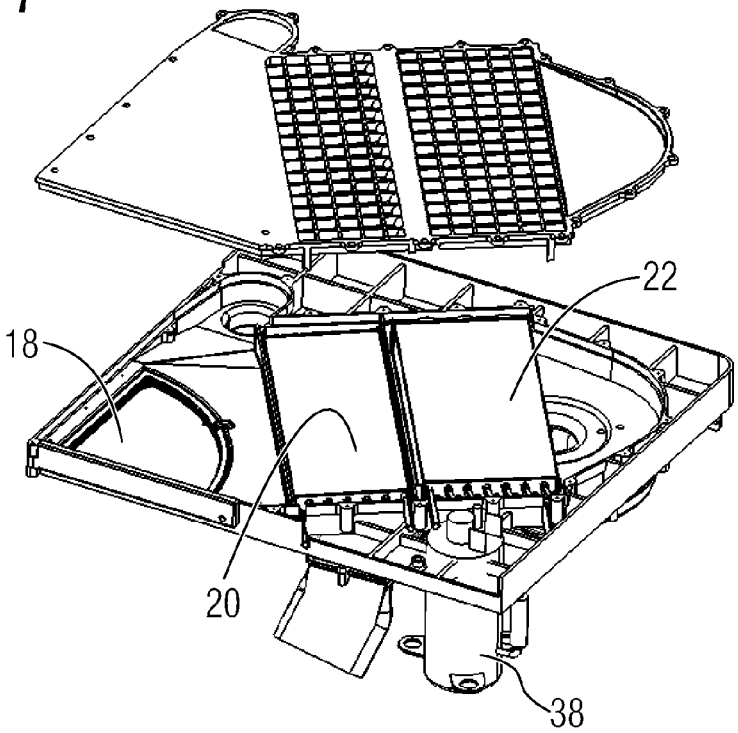
FIG. 7 illustrates a schematic exploded perspective view of the module for the heat pump system according to an embodiment of the present invention.

FIG. 7 illustrates a schematic exploded perspective view of the module 30 for the heat pump system according to an embodiment of the present invention. FIG. 7 is the exploded version of the perspective view in FIG. 6.

FIG. 7 clarifies the positions of the filter arrangement 18, the evaporator 20, the condenser 22 and the compressor 38 within the module 30.

Figure 8:
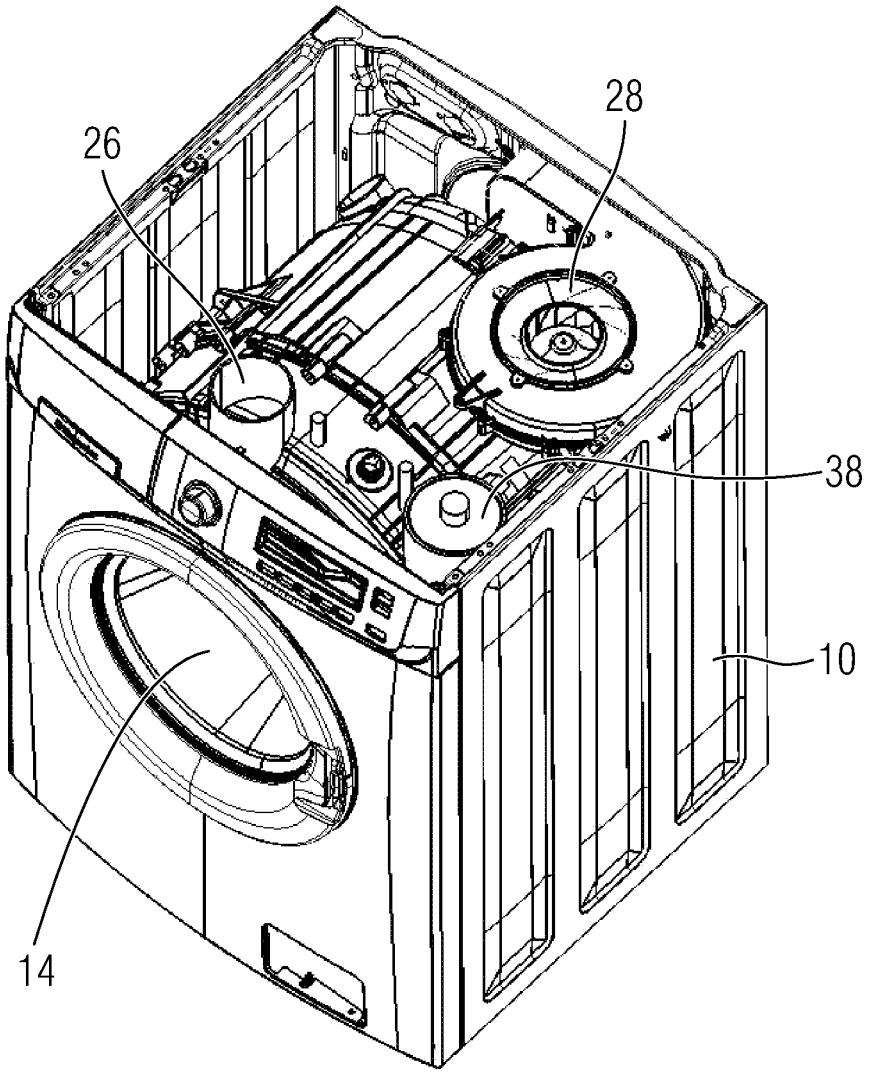
FIG. 8 illustrates a schematic perspective view of the open laundry washing and drying machine according to a further embodiment of the present invention.

FIG. 8 illustrates a schematic perspective view of the open laundry washing and drying machine according to a further embodiment of the present invention.

The washing and drying machine comprises the cabinet 10, the drum 14, the tub outlet 26, the fan inlet 28 and the compressor 38. Unlike the previous described embodiment the tub outlet 26 is arranged in the front portion of the washing and drying machine whereas the tub inlet is arranged in the rear portion of the washing and drying machine as it can be better seen in FIG. 8. The fan inlet 28 and the compressor 38 are arranged at the same positions as in the previous described embodiment.

Figure 9:
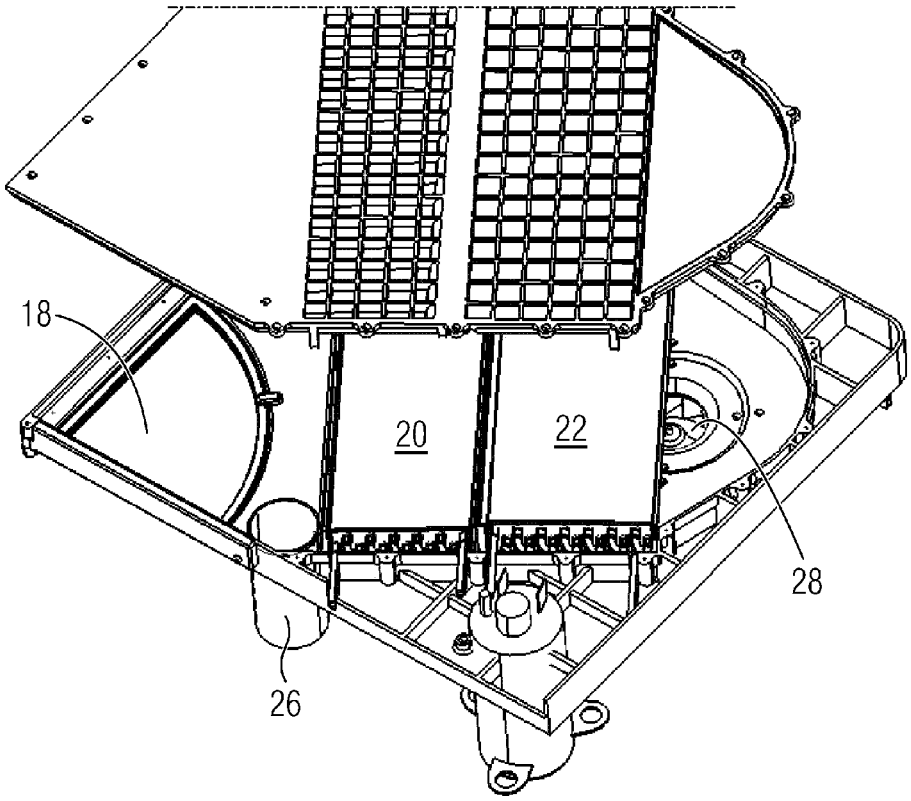
FIG. 9 illustrates a schematic exploded perspective view of the module for the heat pump system according to the further embodiment of the present invention.

FIG. 9 illustrates a schematic exploded perspective view of the module 30 for the heat pump system according to a further embodiment of the present invention. Unlike the previous described embodiment, the tub outlet 26 is arranged in the front portion of the module 30.

The laundry washing and drying machine with the integrated heat pump system according to the present invention can be realized as a compact arrangement. The heat pump system is fastened to the cabinet 10 and/or tub 12. Since the tub 12 does not oscillate during the rotation of the drum, the heat pump system is not affected by vibration.

Further, with present invention it is possible to rigidly connect the air line to tub 12 on one side and to the heat pump system on the other side without the interposition of flexible members.

Further, with present invention the heat pump system can be arranged easily in the upper part of the laundry washing and drying machine, above the tub, since the stationary tub provides more room in that position and additionally enables the heat pump system to be robustly connected and fixed to the same tub.

Although illustrative embodiments of the present invention have been described herein with reference to the accompanying drawings, it is to be understood that the present invention is not limited to those precise embodiments, and that various other changes and modifications may be affected therein by one skilled in the art without departing from the scope or spirit of the invention. All such changes and modifications are intended to be included within the scope of the invention as defined by the appended claims.

In particular the heat pump system can be integrated in the worktop of the laundry washing and drying machine so that the same worktop defines a module ready to be mounted on the side wall of the cabinet.

Alternatively the heat pump system can be fixed to the top wall and/or to the side wall of the cabinet.

Alternatively the heat pump system can be fixed to and entirely supported by the tub.

LIST OF REFERENCE NUMERALS

10 cabinet
12 tub
14 drum
16 vibration damping system
18 filter arrangement
20 evaporator
22 condenser
24 fan
26 tub outlet
28 fan inlet
30 module
32 inlet port for the tub outlet
34 outlet port for the fan inlet
36 compressor housing
38 compressor
40 fan inlet
42 detergent drawer
44 bearing housing
46 first bearing
48 second bearing
50 rotation shaft
52 drive motor
54 damping bracket
56 fastening portion
58 damper and/or spring element

The invention claimed is:

1. A laundry machine with an integrated heat pump system, comprising:
a cabinet;
a stationary tub rigidly attached to the cabinet; and
an air line fluidly connected to the stationary tub and to the heat pump system for air circulation,
wherein:
a rotatable drum is arranged within the stationary tub and resiliently supported by the cabinet and/or the stationary tub through a vibration damping system, and
at least a part of the heat pump system is supported by the cabinet and/or the stationary tub.

2. The laundry machine according to claim 1, wherein the stationary tub comprises or is fluidly connected to an air stream channel, and at least one heat exchanger is arranged within said air stream channel.

3. The laundry machine according to claim 2, wherein the air stream channel is supported by the cabinet and/or the stationary tub.

4. The laundry machine according to claim 2, wherein at least a part of the air stream channel and the stationary tub form a single-piece part.

5. The laundry machine according to claim 1, wherein the laundry machine comprises at least one module including at least one component of the heat pump system.

6. The laundry machine according to claim 5, wherein the module includes at least a part of an air stream channel comprising at least one heat exchanger.

7. The laundry machine according to claim 1, wherein the heat pump system is supported by the cabinet.

8. The laundry machine according to claim 7, wherein the heat pump system is supported by a top wall and/or a side wall of the cabinet.

9. The laundry machine according to claim 1, wherein the heat pump system is integrated in a worktop of the laundry machine so that the same worktop defines a module ready to be mounted on a side wall of the cabinet.

10. The laundry machine according to claim 1, wherein the vibration damping system comprises dampers and/or spring elements.

11. The laundry machine according to claim 1, wherein the rotatable drum is driven by a direct drive motor.

12. The laundry machine according to claim 1, said laundry machine comprising a combination laundry washer and dryer.

13. The laundry machine according to claim 1, wherein said air line forms a closed loop providing air recirculation.

14. A laundry machine comprising:

a cabinet;

a tub rigidly fixed to the cabinet without any dampers or springs connected therebetween;

a rotatable drum elastically supported by at least one of the cabinet and the tub through a vibration damping system; and a heat pump system in fluid communication with the tub, wherein at least a part of the heat pump system is rigidly fixed to the tub.

15. The laundry machine according to claim 14, wherein the tub is fluidly connected to an air stream channel, and wherein at least one heat exchanger of the heat pump system is arranged within the air stream channel.

16. The laundry machine according to claim 15, wherein the air stream channel forms a closed loop providing air recirculation.

17. The laundry machine according to claim 14, wherein the laundry machine further comprises at least one module, and wherein the at least one module includes at least one heat exchanger and at least a part of an air stream channel.

18. The laundry machine according to claim 14, wherein the heat pump system is integrated in a worktop of the laundry machine such that the worktop defines a module ready to be mounted on a side wall of the cabinet.

19. The laundry machine according to claim 14, wherein the vibration damping system comprises at least one of dampers and spring elements.

20. The laundry machine according to claim 14, wherein the laundry machine is a combination laundry washer and dryer.

* * * * *